US010638546B2

(12) United States Patent
Kim et al.

(10) Patent No.: US 10,638,546 B2
(45) Date of Patent: Apr. 28, 2020

(54) PLANAR HEATING DEVICE AND METHOD OF MANUFACTURING THE SAME

(71) Applicant: SAMSUNG ELECTRONICS CO., LTD., Suwon-si, Gyeonggi-do (KR)

(72) Inventors: Doyoon Kim, Hwaseong-si (KR); Haengdeog Koh, Hwaseong-si (KR); Seyun Kim, Seoul (KR); Jinhong Kim, Seoul (KR); Hajin Kim, Hwaseong-si (KR); Soichiro Mizusaki, Suwon-si (KR); Minjong Bae, Yongin-si (KR); Hiesang Sohn, Seoul (KR); Changsoo Lee, Seoul (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 433 days.

(21) Appl. No.: 15/468,451

(22) Filed: Mar. 24, 2017

(65) Prior Publication Data

US 2018/0063890 A1 Mar. 1, 2018

(30) Foreign Application Priority Data

Aug. 26, 2016 (KR) ..... 10-2016-0109553

(51) Int. Cl.

| | |
|---|---|
| ***H05B 3/34*** | (2006.01) |
| ***H05B 3/26*** | (2006.01) |
| ***H05B 3/14*** | (2006.01) |

(52) U.S. Cl.

CPC ..... *H05B 3/34* (2013.01); *H05B 3/141* (2013.01); *H05B 3/145* (2013.01); *H05B 3/26* (2013.01); *H05B 2203/011* (2013.01); *H05B 2203/017* (2013.01); *H05B 2214/04* (2013.01)

(58) Field of Classification Search

CPC . H05B 3/84; H05B 3/845; H05B 3/86; H05B 3/34; H05B 3/141; H05B 3/145; H05B 3/26; H05B 3/342; H05B 3/347; H05B 3/36; H05B 3/38; H05B 3/20; H05B 3/22; H05B 2203/031; H05B 2203/011;

(Continued)

(56) References Cited

U.S. PATENT DOCUMENTS

2010/0122980 A1* 5/2010 Wang ..... H05B 3/145 219/553

2010/0176110 A1 7/2010 Ogino et al.

FOREIGN PATENT DOCUMENTS

JP 2003157958 A 5/2003

JP 2008269914 A 11/2008

(Continued)

OTHER PUBLICATIONS

Yeo-Hwan Yoon et al., Transparant Film Heater Using Single-Walled Carbon Nanotubes, 2007, pp. 4284-4287, 19, Wiley Inter Science, Wiley-VCH Verlag GmbH & Co. KGaA, Weinheim.

(Continued)

*Primary Examiner* — Shawntina T Fuqua

(74) *Attorney, Agent, or Firm* — Cantor Colburn LLP

(57) ABSTRACT

A planar heating device includes a substrate, first and second electrodes disposed on both ends of the substrate, a heating layer disposed on the substrate and configured to contact the first and second electrodes, a first additional heating layer disposed on one end of the heating layer, and a second additional heating layer disposed on the other end of the heating layer.

17 Claims, 4 Drawing Sheets

(58) Field of Classification Search
CPC ..... H05B 2203/017; H05B 2203/04; H05B 2203/013; H05B 2214/02
See application file for complete search history.

(56) References Cited

FOREIGN PATENT DOCUMENTS

| | | | |
|---|---|---|---|
| JP | 2011212079 | A | 10/2011 |
| JP | 2014146478 | A | 8/2014 |

OTHER PUBLICATIONS

Daewoong Jung et al., Transparent film heaters using multi-walled carbon nanotube sheets, Article, 2013, pp. 176-180, Elsevier.

* cited by examiner

PLANAR HEATING DEVICE AND METHOD OF MANUFACTURING THE SAME

CROSS-REFERENCE TO RELATED APPLICATION

This application claims priority to Korean Patent Application No. 10-2016-0109553, filed on Aug. 26, 2016, and all the benefits accruing therefrom under 35 U.S.C. § 119, the content of which in its entirety is herein incorporated by reference.

BACKGROUND

1. Field

The disclosure relates to a planar heating device and a method of manufacturing the planar heating device, and more particularly, to a planar heating device in which thermal damage of an electrode is prevented by adjusting a thickness of a heating layer of the planar heating device and a method of manufacturing the planar heating device.

2. Description of the Related Art

A typical planar heating element, which generates heat by electricity, has been widely used in residential heating systems of apartments or conventional houses requiring heating because the planar heating element does not cause air pollution or generate noise, and temperature may be easily controlled. Furthermore, the planar heating element has been more widely used in recent times since a heating value of the planar heating element is high, and rapid heating control is possible compared to existing linear heating elements. The planar heating element is used, for example, in heating systems of commercial buildings such as offices or stores, industrial heating systems of workshops, warehouses, or camps, various industrial heating systems, agricultural facilities such as greenhouses or agricultural product drying systems, and various freeze protection devices capable of melting snow on roads or parking lots or preventing freezing, and may be further used for leisure, cold protection, household appliances, defogging devices for mirrors or glass, healthcare products, and livestock raising. Recently, manufacturing of a single-wall/multi-wall carbon nanotube ("CNT") or a heating element using heating characteristics of conductive oxide has been conducted in research institutes and industries.

SUMMARY

Embodiments of the invention are directed to a planar heating device in which thermal damage of an electrode is effectively prevented by adjusting a thickness of a heating layer of the planar heating device and a method of manufacturing the planar heating device.

According to an embodiment, a planar heating device includes a substrate, a first electrode disposed on an end portion of the substrate, a second electrode disposed on an opposing end portion of the substrate, a heating layer disposed on the substrate and in contact with the first and second electrodes, a first additional heating layer disposed on an end portion of the heating layer, and a second additional heating layer disposed on an opposing end portion of the heating layer.

In an embodiment, the first additional heating layer may contact the first electrode, and the second additional heating layer may contact the second electrode.

In an embodiment, a resistance of each of a region of the heating layer, on which the first additional heating layer is disposed, and a region of the heating layer, on which the second additional heating layer is disposed, may be lower than a resistance of a region of the heating layer, on which the first and second additional heating layers are not disposed.

In an embodiment, each of the heating layer, the first additional heating layer and the second additional heating layer may include carbon nanotubes ("CNT"s).

In an embodiment, each of the heating layer, the first additional heating layer and the second additional heating layer may include a conductive oxide film, where the conductive oxide film may include at least one of $RuO_2$, $MnO_2$, $VO_2$, $TaO_2$, $IrO_2$, $NbO_2$, $WO_2$, $GaO_2$, $MoO_2$, $InO_2$, $CrO_2$, and $RhO_2$.

In an embodiment, a thickness of the heating layer may be in a range of about 10 micrometers (μm) to about 100 μm, and a thickness of each of the first and second additional heating layers may be in a range of about 10 μm to about 100 μm.

In an embodiment, the thickness of each of the first and second additional heating layers may be equal to or greater than the thickness of the heating layer.

In an embodiment, the thickness of each of the first and second additional heating layers may be equal to or twice the thickness of the heating layer.

In an embodiment, a width of each of the first and second additional heating layers may be in a range of about 10 millimeters (mm) to about 20 mm.

In an embodiment, each of the first and second electrodes may include at least one of silver (Ag), aluminum (Al), indium tin oxide ("ITO"), copper (Cu), molybdenum (Mo), and platinum (Pt).

According to another embodiment, a method of manufacturing a planar heating device includes preparing a substrate, providing first and second electrodes on opposing end portions of the substrate, respectively, providing a heating layer on the substrate in a way such that the heating layer contacts the first and second electrodes, providing a first additional heating layer on an end portion of the heating layer, and providing a second additional heating layer on an opposing end portion of the heating layer.

In an embodiment, the first additional heating layer may contact the first electrode, and the second additional heating layer may contact the second electrode.

In an embodiment, resistance of each of a region of the heading layer, on which the first additional heating layer is provided, and a region of the heading layer, on which the second additional heating layer is provided, may be lower than resistance of a region of the heading layer, on which the first and second additional heating layers are not provided.

In an embodiment, a thickness of the heating layer may be in a range of about 10 μm to about 100 μm, and a thickness of each of the first and second additional heating layers may be in a range of about 10 μm to about 100 μm.

In an embodiment, the thickness of each of the first and second additional heating layers may be equal to or greater than the thickness of the heating layer.

In an embodiment, the thickness of each of the first and second additional heating layers may be equal to or twice the thickness of the heating layer.

In an embodiment, a width of each of the first and second additional heating layers may be in a range of about 10 mm to about 20 mm.

BRIEF DESCRIPTION OF THE DRAWINGS

These and/or other features will become apparent and more readily appreciated from the following description of the embodiments, taken in conjunction with the accompanying drawings, in which.

DETAILED DESCRIPTION

Figure 1:
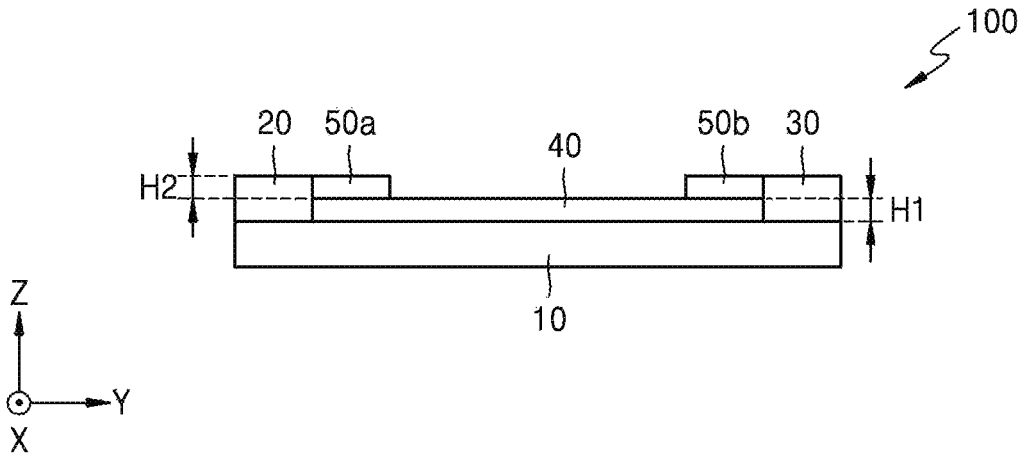
FIG. 1 is a cross-sectional view of a planar heating device according to an exemplary embodiment.

Reference will now be made in detail to embodiments, examples of which are illustrated in the accompanying drawings, where like reference numerals refer to like elements throughout. In this regard, the embodiments may have different forms and should not be construed as being limited to the descriptions set forth herein. Accordingly, the embodiments are merely described below, by referring to the figures, to explain aspects. Expressions such as "at least one of," when preceding a list of elements, modify the entire list of elements and do not modify the individual elements of the list.

Throughout the specification, it will be understood that when a unit is referred to as being "connected" to another element, it may be "directly connected" to the other element or "electrically connected" to the other element in a state in which intervening elements are present.

It will be understood that when an element is referred to as being "on" another element, it can be directly on the other element or intervening elements may be present therebetween. In contrast, when an element is referred to as being "directly on" another element, there are no intervening elements present.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Figure 2:
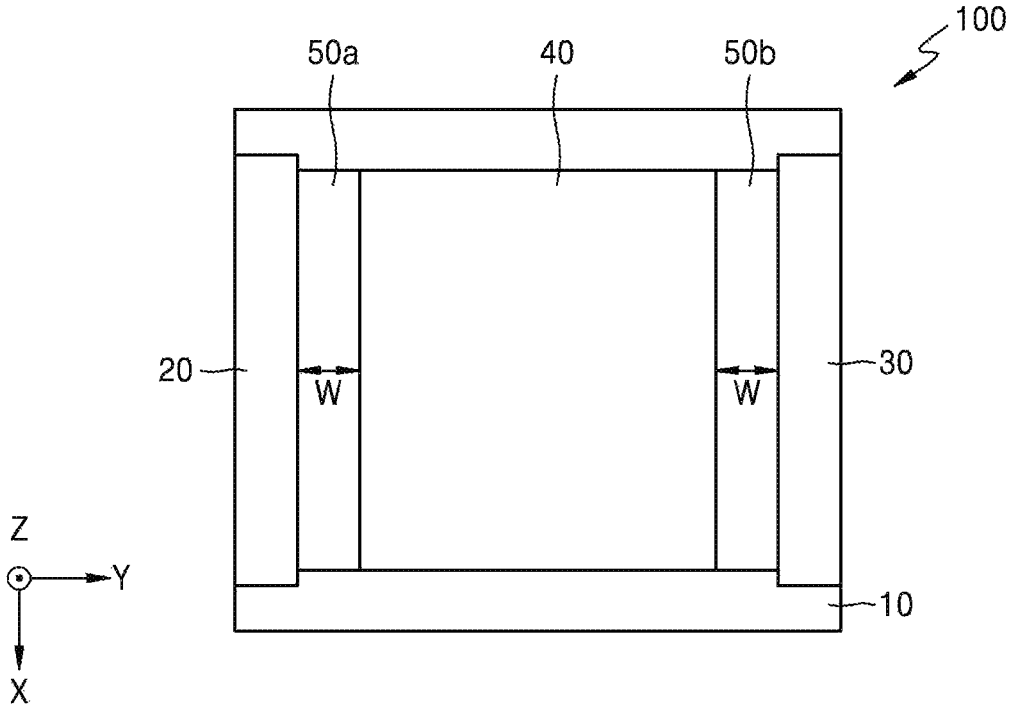
FIG. 2 is a plan view of a planar heating device according to an exemplary embodiment.

FIG. 1 is a cross-sectional view of a planar heating device 100 according to an exemplary embodiment, and FIG. 2 is a plan view of the planar heating device 100 according to an exemplary embodiment.

Referring to FIG. 1, an exemplary embodiment of the planar heating device 100 may include a substrate 10, a first electrode 20, a second electrode 30, a heating layer 40, a first additional heating layer 50*a*, and a second additional heating layer 50*b*.

The substrate 10 may be a plastic substrate or a glass substrate.

The first and second electrodes 20 and 30 may be disposed on opposing end portions of the substrate 10. The first and second electrodes 20 and 30 may directly contact the substrate 10, or may be spaced apart from the substrate 10 with an additional layer (not shown) interposed therebetween. In one embodiment, for example, the additional layer may be the heating layer 40.

The first and second electrodes 20 and 30 may include a material having high electrical conductivity. The first and second electrodes 20 and 30 may include, but are not limited to, at least one of silver (Ag), aluminum (Al), indium tin oxide ("ITO"), copper (Cu), molybdenum (Mo), and platinum (Pt).

The heating layer 40 may be on the substrate 10 and may contact the first and second electrodes 20 and 30. The heating layer 40 may include a carbon nanotube ("CNT"). The CNT may be at least one of single-wall CNT, double-wall CNT, multi-wall CNT and twisted CNT, or a combination thereof. In one embodiment, for example, multi-wall CNT may be used to reduce manufacturing cost. In an embodiment, the heating layer 40 may include a conductive oxide film. The conductive oxide film may include, for example, at least one of $RuO_2$, $MnO_2$, $VO_2$, $TaO_2$, $IrO_2$, $NbO_2$, $WO_2$, $GaO_2$, $MoO_2$, $InO_2$, $CrO_2$, and $RhO_2$, or any combination thereof, but is not limited thereto.

The first additional heating layer 50*a* may be disposed on one end portion of the heating layer 40, and the second additional heating layer 50*b* may be disposed on an opposing end portion of the heating layer 40. In such an embodiment, the first additional heating layer 50*a* may contact the first electrode 20, and the second additional heating layer 50*b* may contact the second electrode 30.

The first and second additional heating layers 50*a* and 50*b* may include a same metal as a metal included in the heating layer 40. In one embodiment, for example, the first and second additional heating layers 50*a* and 50*b* may include CNT. The CNT may be at least one of single-wall CNT, double-wall CNT, multi-wall CNT and twisted CNT, or a combination thereof. In one embodiment, for example, multi-wall CNT may be used to reduce manufacturing cost. In an embodiment, the first and second additional heating layers 50*a* and 50*b* may include a conductive oxide film. The conductive oxide film may include, for example, at least one of $RuO_2$, $MnO_2$, $VO_2$, $TaO_2$, $IrO_2$, $NbO_2$, $WO_2$, $GaO_2$, $MoO_2$, $InO_2$, $CrO_2$, and $RhO_2$, or any combination thereof, but is not limited thereto.

A thickness H1 of the heating layer 40 may be in a range of about 10 μm to about 100 μm, and a thickness H2 of each of the first and second additional heating layers 50*a* and 50*b* may be in a range of about 10 μm to about 100 μm. In an embodiment, the thickness H2 of each of the first and second additional heating layers 50*a* and 50*b* may be equal to or greater than the thickness H1 of the heating layer 40. In one embodiment, for example, the thickness H2 of each of the first and second additional heating layers 50*a* and 50*b* may be equal to or twice the thickness H1 of the heating layer 40.

Resistance of each of a region where the first additional heating layer 50*a* is disposed on the heating layer 40 and a region where the second additional heating layer 50*b* is disposed on the heating layer 40 may be lower than resistance of a region where the first and second additional heating layers 50*a* and 50*b* are not disposed on the heating layer 40.

In an embodiment, as shown in FIG. 2, the first electrode 20, the region of the heating layer 40 on which the first additional heating layer 50*a* is disposed, the region of the heating layer 40 on which the first and second additional heating layers 50*a* and 50*b* are not disposed, the region of the heating layer 40 on which the second additional heating layer 50*b* is disposed, and the second electrode 30 may be connected to each other in series. In such an embodiment, when a voltage is applied to the first and second electrodes 20 and 30, the voltage may be applied to the region of the heating layer 40 on which the first additional heating layer 50*a* is disposed, the region of the heating layer 40 on which the first and second additional heating layers 50*a* and 50*b* are not disposed, and the region of the heating layer 40 on which the second additional heating layer 50*b* is disposed. Since a resistance value of each of the regions of the heating layer 40 on which the first additional heating layer 50*a* and the second additional heating layer 50*b* are disposed, respectively, is lower than a resistance of the region of the heating layer 40 on which the first and second additional heating layers 50*a* and 50*b* are not disposed, a voltage, which is lower than that applied to the region of the heating layer 40 on which the first and second additional heating layers 50*a* and 50*b* are not disposed, may be applied to each of the regions of the heating layer 40 on which the first additional heating layer 50*a* and the second additional heating layer 50*b* are disposed, respectively. Therefore, power consumption of each of the region of the heating layer 40 on which the first additional heating layer 50*a* and the second additional heating layer 50*b* are disposed, respectively, may be less than that of the region of the heating layer 40 on which the first and second additional heating layers 50*a* and 50*b* are not disposed, and thus, less heat may be generated from such regions. Therefore, the regions of the heating layer 40 on which the first and second additional heating layers 50*a* and 50*b* are disposed may function as an electrode protective layer for effectively preventing thermal damage of the first and second electrodes 20 and 30.

Referring to FIG. 2, a width W of each of the first and second additional heating layers 50*a* and 50*b* may have a length predetermined to effectively prevent thermal damage of the first and second electrodes 20 and 30. In one embodiment, for example, the width W of each of the first and second additional heating layers 50*a* and 50*b* may be in a range of about 10 millimeters (mm) to about 20 mm.

Figure 3A:
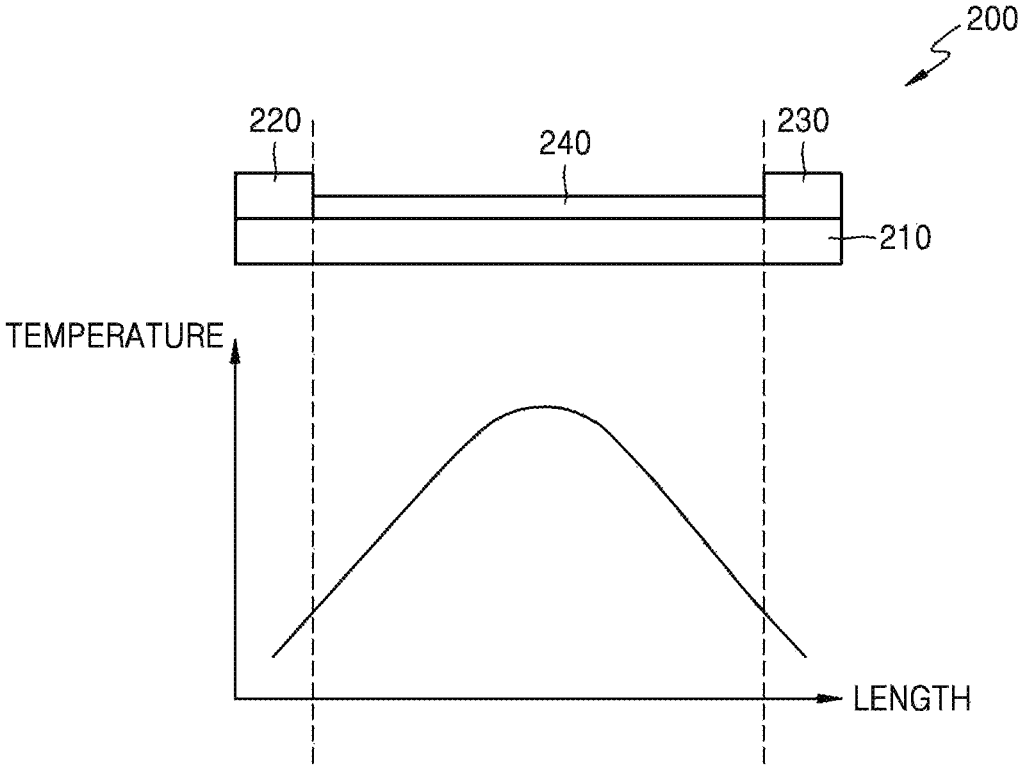
FIG. 3A is a graph illustrating a temperature distribution of a planar heating device according to a position of the planar heating device when an additional heating layer is not provided on a heating layer.
Figure 3B:
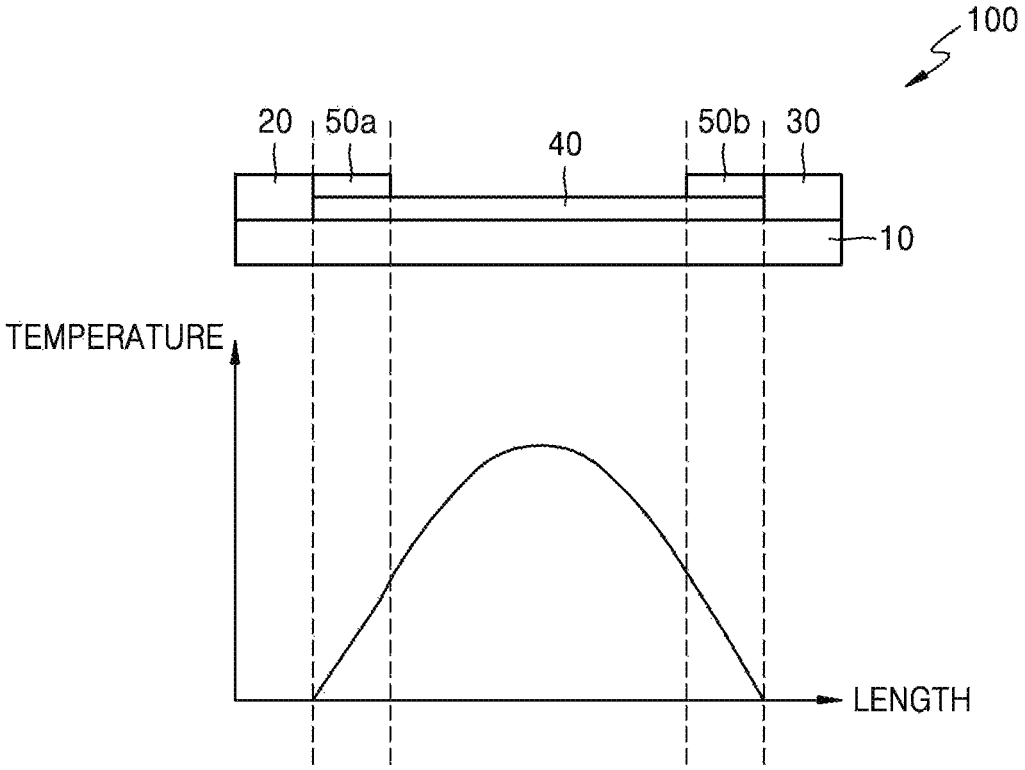
FIG. 3B is a graph illustrating a temperature distribution of a planar heating device according to a position of the planar heating device when an additional heating layer is provided on a heating layer according to an exemplary embodiment.

FIG. 3A is a graph illustrating a temperature distribution of a planar heating device 200 according to a position of the planar heating device 200 when an additional heating layer is not disposed on a heating layer 240, and FIG. 3B is a graph illustrating a temperature distribution of the planar heating device 100 according to a position of the planar heating device 100 when the additional heating layers 50*a* and 50*b* are disposed on the heating layer 40 according to an exemplary embodiment.

Referring to FIG. 3A, a first electrode 220, the heating layer 240, and a second electrode 230 are connected to each other in series in the planar heating device 200. A voltage may be applied to the heating layer 240 when a voltage is applied to the first and second electrodes 220 and 230. The heating layer 240 may have a uniform distribution of materials and a uniform thickness, and thus, an identical voltage may be applied to the entire region of the heating layer 240. A temperature may increase from a contour to a center portion of the heating layer 240 due to a reinforcing effect of heat generated from the heating layer 240, and a temperature may decrease from the center portion to the contour of the heating layer 240.

In general, contact resistance may be generated in a contact portion contacting the first and second electrodes 220 and 230, and the heating layer 240. Furthermore, the contact resistance may increase due to heat generated from a contour portion of the heating layer 240, that is, a peripheral region of the contact portion. The contact portion may be partially heated due to the increase in the contact resistance, and a temperature of the contact portion may further increase due to a secondary formation of an oxide film. As a result, an operation failure of the heating layer 240 and thermal damage of the first and second electrodes 220 and 230 may occur.

Referring to FIG. 3B, in an embodiment of the planar heating device 100, the first electrode 20, the region of the heating layer 40 on which the first additional heating layer 50*a* is disposed, the region of the heating layer 40 on which the first and second additional heating layers 50*a* and 50*b* are not disposed, the region of the heating layer 40 on which the second additional heating layer 50*b* is disposed, and the second electrode 30 are connected to each other in series. When a voltage is applied to the first and second electrodes 20 and 30, a voltage may be applied to the region where the first additional heating layer 50*a* is disposed on the heating layer 40, the region of the heating layer 40 on which the first and second additional heating layers 50*a* and 50*b* are not disposed, and the region of the heating layer 40 on which the second additional heating layer 50*b* is disposed. Since a resistance value of each of the regions of the heating layer 40 on which the first additional heating layer 50*a* and the second additional heating layer 50*b* are disposed, respectively, is lower than that of the region of the heating layer 40 on which the first and second additional heating layers 50*a* and 50*b* are not disposed, a voltage, which is lower than that applied to the region of the heating layer 40 on which the first and second additional heating layers 50*a* and 50*b* are not disposed, may be applied to each of the regions of the heating layer 40 on which the first additional heating layer 50*a* and the second additional heating layer 50*b* are disposed, respectively. Therefore, power consumption of each of the regions of the heating layer 40 on which the first additional heating layer 50*a* and the second additional heating layer 50*b* are disposed, respectively, may be less than that of the region of the heating layer 40 on which the first and second additional heating layers 50*a* and 50*b* are not disposed, and thus, less heat may be generated from such regions. Accordingly, a temperature around the first and second electrodes 20 and 30 of FIG. 3B may be lower than that around the first and second electrodes 220 and 230 of FIG. 3A.

In such an embodiment, an increase in contact resistance of a contact portion, which contacts the first and second electrodes 20 and 30, the heating layer 40, and the first and second additional heating layers 50*a* and 50*b*, due to heat generated from the contact portion may be less than an increase in contact resistance of a contact portion, which contacts the first and second electrodes 20 and 30, and the heating layer 40 without the first and second additional heating layers 50*a* and 50*b*. Therefore, the regions of the heating layer 40 on which the first and second additional heating layers 50*a* and 50*b* are disposed may function as an electrode protective layer for effectively preventing thermal damage of the first and second electrodes 20 and 30.

FIGS. 4A to 4D are cross-sectional views illustrating a method of manufacturing a planar heating device according to an exemplary embodiment.

Figure 4A:
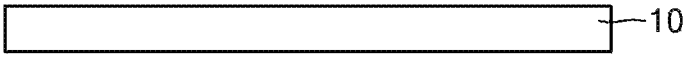
FIGS. 4A to 4D are cross-sectional views illustrating a method of manufacturing a planar heating device according to an exemplary embodiment.
Figure 4B:
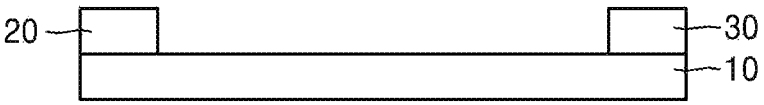

Referring to FIGS. 4A and 4B, a substrate 10 including a plastic substrate or a glass substrate is prepared, and the first and second electrodes 20 and 30 are provided on opposing end portions of the substrate 10. The first and second electrodes 20 and 30 may directly contact the substrate 10, or may be spaced apart from the substrate 10 and with an additional layer (not shown) interposed therebetween.

The first and second electrodes 20 and 30 may include a material having high electrical conductivity. The first and second electrodes 20 and 30 may include, but are not limited to, at least one of Ag, Al, ITO, Cu, Mo, and Pt.

Figure 4C:
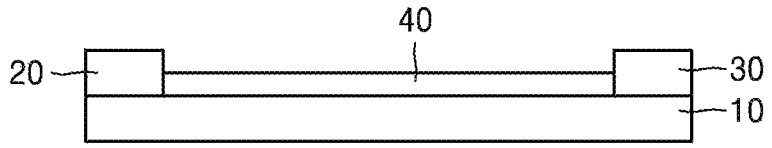

Referring to FIG. 4C, the heating layer 40 is provided on the substrate 10 to contact the first and second electrodes 20 and 30. A thickness of the heating layer 40 may be in a range of about 10 micrometers (μm) to about 100 μm.

The heating layer 40 may include CNT. The CNT may be at least one of single-wall CNT, double-wall CNT, multi-wall CNT, and twisted CNT, or a combination thereof. In one embodiment, for example, multi-wall CNT may be used to reduce manufacturing cost. In an embodiment, the heating layer 40 may include a conductive oxide film. The conductive oxide film may include, for example, at least one of $RuO_2$, $MnO_2$, $VO_2$, $TaO_2$, $IrO_2$, $NbO_2$, $WO_2$, $GaO_2$, $MoO_2$, $InO_2$, $CrO_2$, and $RhO_2$, or any combination thereof, but is not limited thereto.

Figure 4D:
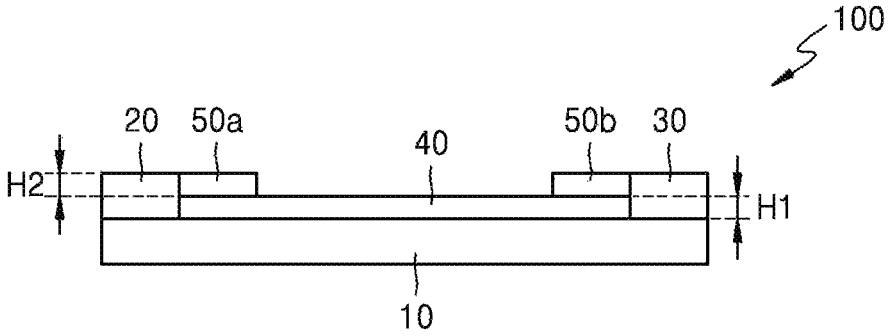

Referring to FIG. 4D, the first additional heating layer 50*a* is disposed on an end portion of the heating layer 40, and the second additional heating layer 50*b* is disposed on an opposing end portion of the heating layer 40. The first additional heating layer 50*a* may contact the first electrode 20, and the second additional heating layer 50*b* may contact the second electrode 30. The first and second additional heating layers 50*a* and 50*b* may include a same metal as that of the heating layer 40.

The thickness H2 of each of the first and second additional heating layers 50*a* and 50*b* may be in a range of about 10 μm to about 100 μm. In an embodiment, the thickness H2 of each of the first and second additional heating layers 50*a* and 50*b* may be equal to or greater than the thickness H1 of the heating layer 40. In one embodiment, for example, the thickness H2 of each of the first and second additional heating layers 50*a* and 50*b* may be equal to or twice the thickness H1 of the heating layer 40.

A width of each of the first and second additional heating layers 50*a* and 50*b* may have a length predetermined to effectively prevent thermal damage of the first and second electrodes 20 and 30. In one embodiment, for example, the width of each of the first and second additional heating layers 50*a* and 50*b* may be in a range of about 10 mm to about 20 mm.

Resistance of each of a region of the heating layer 40 on which the first additional heating layer 50*a* is disposed and a region the heating layer 40 on which the second additional heating layer 50*b* is disposed may be lower than resistance of a region the heating layer 40 on which the first and second additional heating layers 50*a* and 50*b* are not disposed.

According to embodiments of a planar heating device and a method of manufacturing the planar heating device, resistance of a heating layer adjacent to an electrode may be lowered by increasing a thickness of the heating layer adjacent to the electrode. As a result, a temperature of the heating layer adjacent to the electrode may be reduced and thermal damage of the electrode may be effectively prevented.

In such embodiments, a center portion of the heating layer may generate more heat by applying a higher voltage to the center portion of the heating layer.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope as defined by the following claims.

What is claimed is:

1. A planar heating device comprising:

a substrate;

a first electrode disposed on an end portion of the substrate;

a second electrode disposed on an opposing end portion of the substrate;

a heating layer disposed on the substrate and in contact with the first and second electrodes;

a first additional heating layer disposed on an end portion of the heating layer; and a second additional heating layer disposed on an opposing end portion of the heating layer, wherein the first additional heating layer is separated from the second additional heating layer.

2. The planar heating device of claim 1, wherein the first additional heating layer contacts the first electrode, and the second additional heating layer contacts the second electrode.

3. The planar heating device of claim 1, wherein a resistance of each of a region of the heating layer, on which the first additional heating layer is disposed, and a region of the heating layer, on which the second additional heating layer is disposed, is lower than a resistance of a region of the heating layer, on which the first and second additional heating layers are not disposed.

4. The planar heating device of claim 1, wherein each of the heating layer, the first additional heating layer and the second additional heating layer comprises carbon nanotubes.

5. The planar heating device of claim 1, wherein each of the heating layer, the first additional heating layer and the second additional heating layer comprises a conductive oxide film, wherein the conductive oxide film comprises at least one of $RuO_2$, $MnO_2$, $VO_2$, $TaO_2$, $IrO_2$, $NbO_2$, $WO_2$, $GaO_2$, $MoO_2$, $InO_2$, $CrO_2$, and $RhO_2$.

6. The planar heating device of claim 1, wherein a thickness of the heating layer is in a range of about 10 micrometers to about 100 micrometers, and a thickness of each of the first and second additional heating layers is in a range of about 10 micrometers to about 100 micrometers.

7. The planar heating device of claim 6, wherein the thickness of each of the first and second additional heating layers is equal to or greater than the thickness of the heating layer.

8. The planar heating device of claim 7, wherein the thickness of each of the first and second additional heating layers is equal to or twice the thickness of the heating layer.

9. The planar heating device of claim 1, wherein a width of each of the first and second additional heating layers is in a range of about 10 millimeters to about 20 millimeters.

10. The planar heating device of claim 1, wherein each of the first and second electrodes comprises at least one of silver, aluminum, indium tin oxide, copper, molybdenum, and platinum.

11. A method of manufacturing a planar heating device, the method comprising:

preparing a substrate;

providing first and second electrodes on opposing end portions of the substrate, respectively;

providing a heating layer on the substrate in a way such that the heating layer contacts the first and second electrodes;

providing a first additional heating layer on an end portion of the heating layer; and providing a second additional heating layer on an opposing end portion of the heating layer, wherein the first additional heating layer is separated from the second additional heating layer.

12. The method of claim 11, wherein the first additional heating layer contacts the first electrode, and the second additional heating layer contacts the second electrode.

13. The method of claim 11, wherein resistance of each of a region of the heading layer, on which the first additional heating layer is provided, and a region of the heading layer, on which the second additional heating layer is provided, is lower than resistance of a region of the heading layer on which the first and second additional heating layers are not provided.

14. The method of claim 11, wherein a thickness of the heating layer is in a range of about 10 micrometers to about 100 micrometers, and a thickness of each of the first and second additional heating layers is in a range of about 10 micrometers to about 100 μm micrometers.

15. The method of claim 14, wherein the thickness of each of the first and second additional heating layers is equal to or greater than the thickness of the heating layer.

16. The method of claim 15, wherein the thickness of each of the first and second additional heating layers is equal to or twice the thickness of the heating layer.

17. The method of claim 11, wherein a width of each of the first and second additional heating layers is in a range of about 10 millimeters to about 20 millimeters.

* * * * *